US006874976B2

(12) United States Patent
Shimada

(10) Patent No.: US 6,874,976 B2
(45) Date of Patent: Apr. 5, 2005

(54) MULTIPOINT GROUTING METHOD AND APPARATUS THEREFOR

(75) Inventor: Shunsuke Shimada, Tokyo (JP)

(73) Assignee: Kyokado Engineering Co., Ltd., Tokyo (JP)

( * ) Notice: Subject to any disclaimer, the term of this patent is extended or adjusted under 35 U.S.C. 154(b) by 0 days.

(21) Appl. No.: 10/370,068

(22) Filed: Feb. 21, 2003

(65) Prior Publication Data

US 2004/0165959 A1 Aug. 26, 2004

(51) Int. Cl.[7] ..... C09K 17/00
(52) U.S. Cl. ..... 405/266; 405/269
(58) Field of Search ..... 405/266, 267, 405/269, 302.4, 263, 264, 265, 302.5

(56) References Cited

U.S. PATENT DOCUMENTS 2,560,619 A * 7/1951 Wertz ..... 405/267
4,072,017 A * 2/1978 Shiraki ..... 405/270
5,419,632 A * 5/1995 Stephens ..... 366/3
5,905,184 A * 5/1999 Carter, Jr. ..... 588/260
6,302,624 B1 * 10/2001 Nasu et al. ..... 405/269
6,322,294 B1 * 11/2001 Nasu et al. ..... 405/269
6,368,019 B2 * 4/2002 Sugawa et al. ..... 405/128.45

FOREIGN PATENT DOCUMENTS

JP 57081516 A * 5/1982 ..... E02D/03/12
JP 58204212 A * 11/1983 ..... E02D/03/12
JP 59010609 A * 1/1984 ..... E02D/03/12
JP 59027020 A * 2/1984 ..... E02D/03/12
JP 61145280 A * 7/1986 ..... C09K/17/00

* cited by examiner

*Primary Examiner*—Heather Shackelford
*Assistant Examiner*—Lisa M. Saldano
(74) *Attorney, Agent, or Firm*—Venable LLP; Catherine M. Voorhees

(57) ABSTRACT

A common feature of the method and apparatus for multipoint grouting resides in using a multiple injection apparatus having a plurality of unit pumps in one plant, driven independently of each other and controlled by a centralized control device. The plurality of the unit pumps are connected through ducts to a plurality of injection pipes each having an outlet, inserted in a plurality of injection points in ground. By operations of the plurality of the unit pumps, ground improving material is injected from the plurality of the outlets into the plurality of the injection points in the ground.

13 Claims, 12 Drawing Sheets

[Fig. 1]
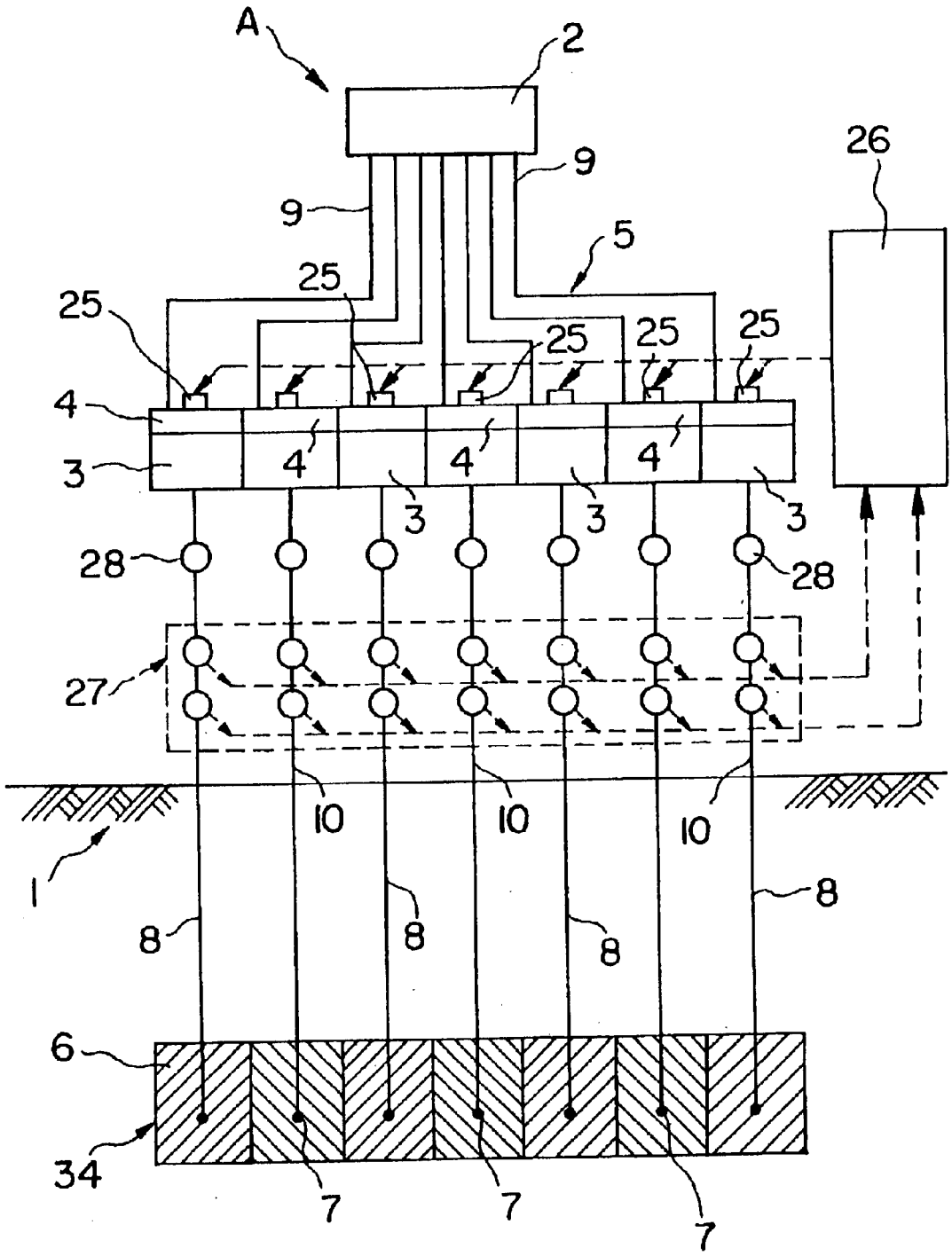

[Fig. 2]
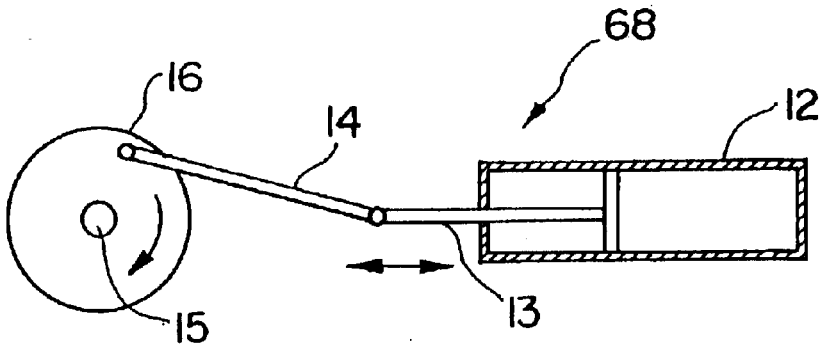
[Fig. 4]
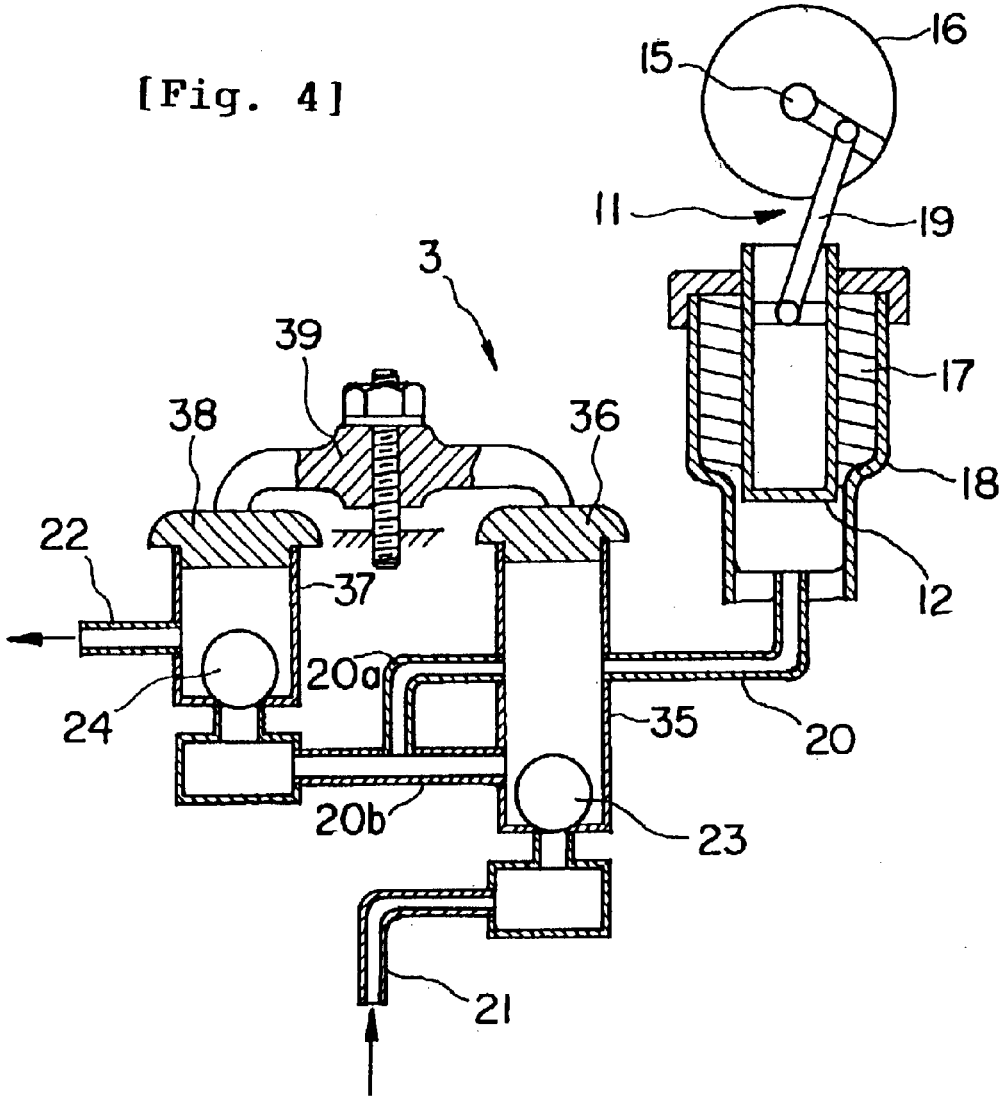

[Fig. 3]
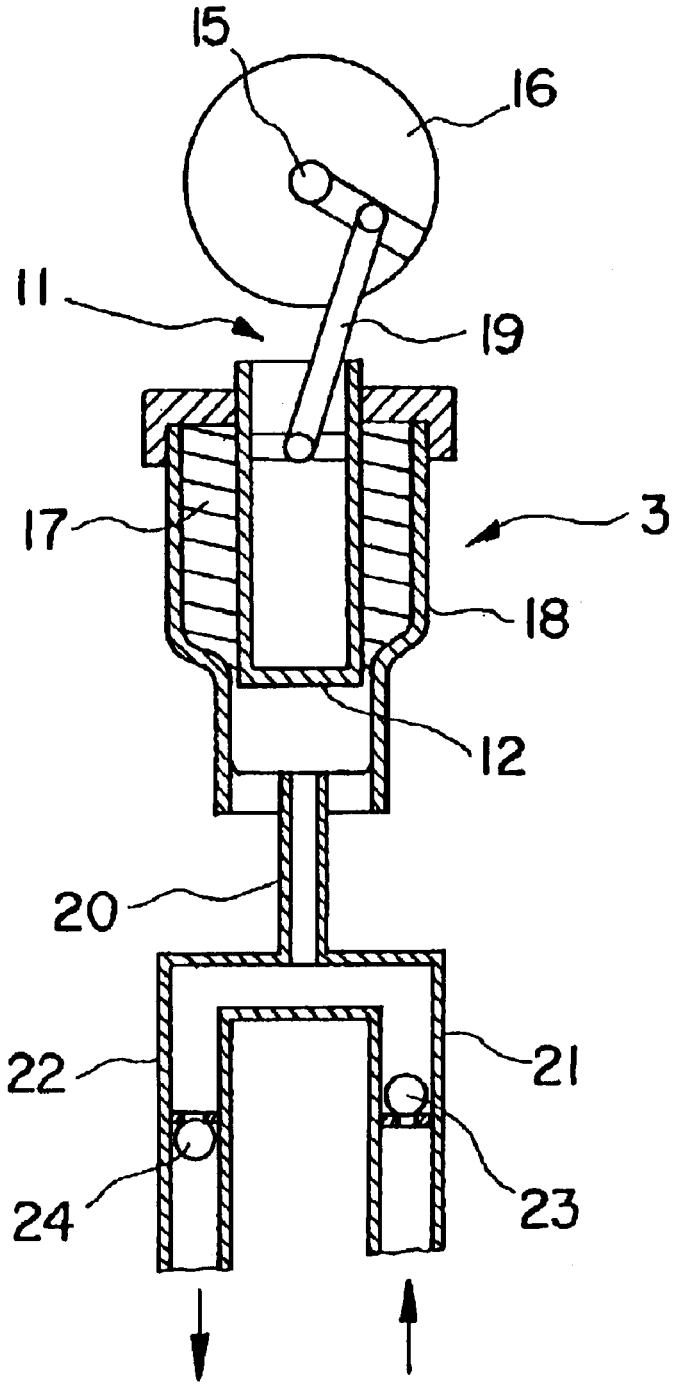

[Fig. 5]
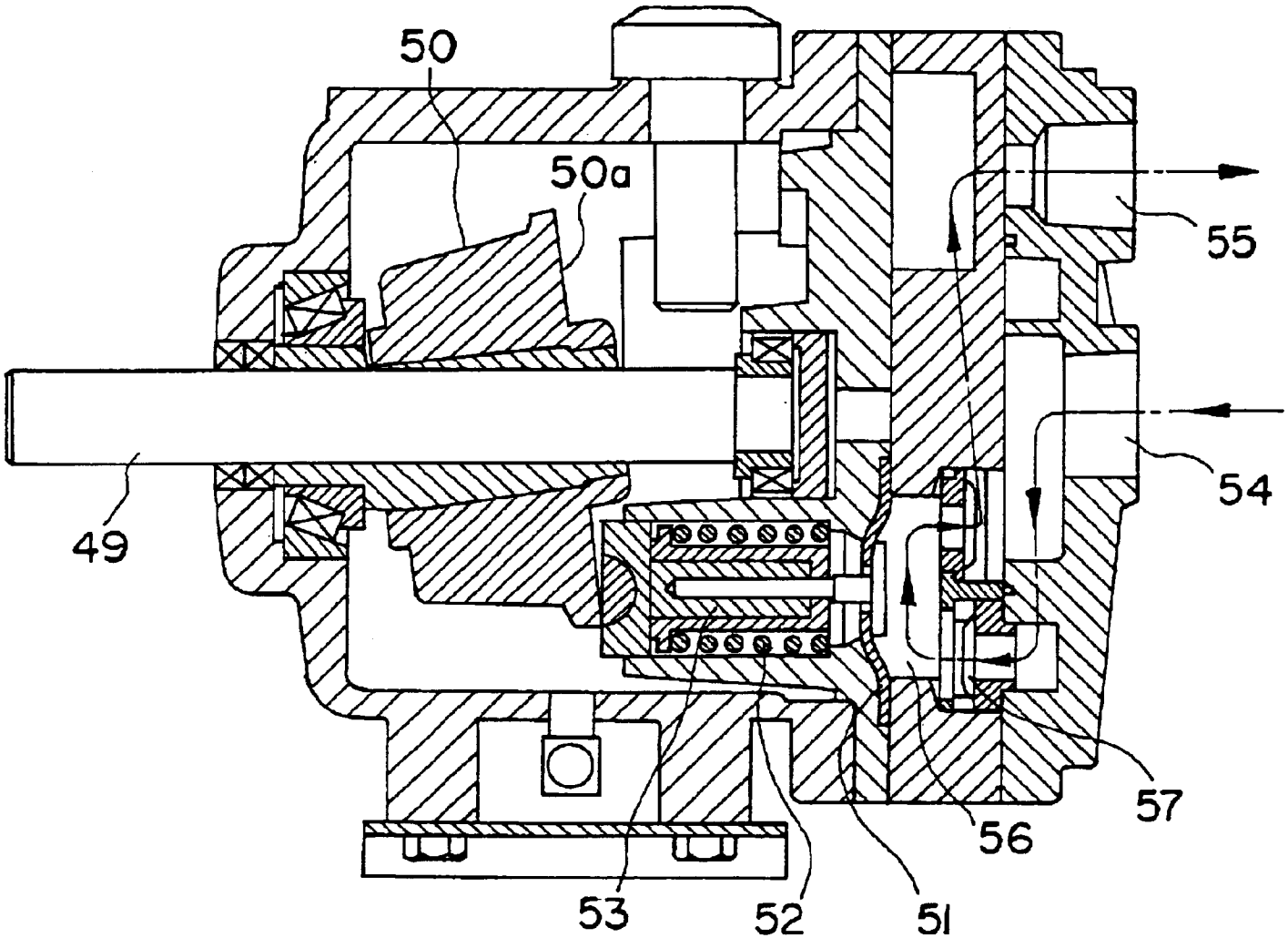

[Fig. 6]
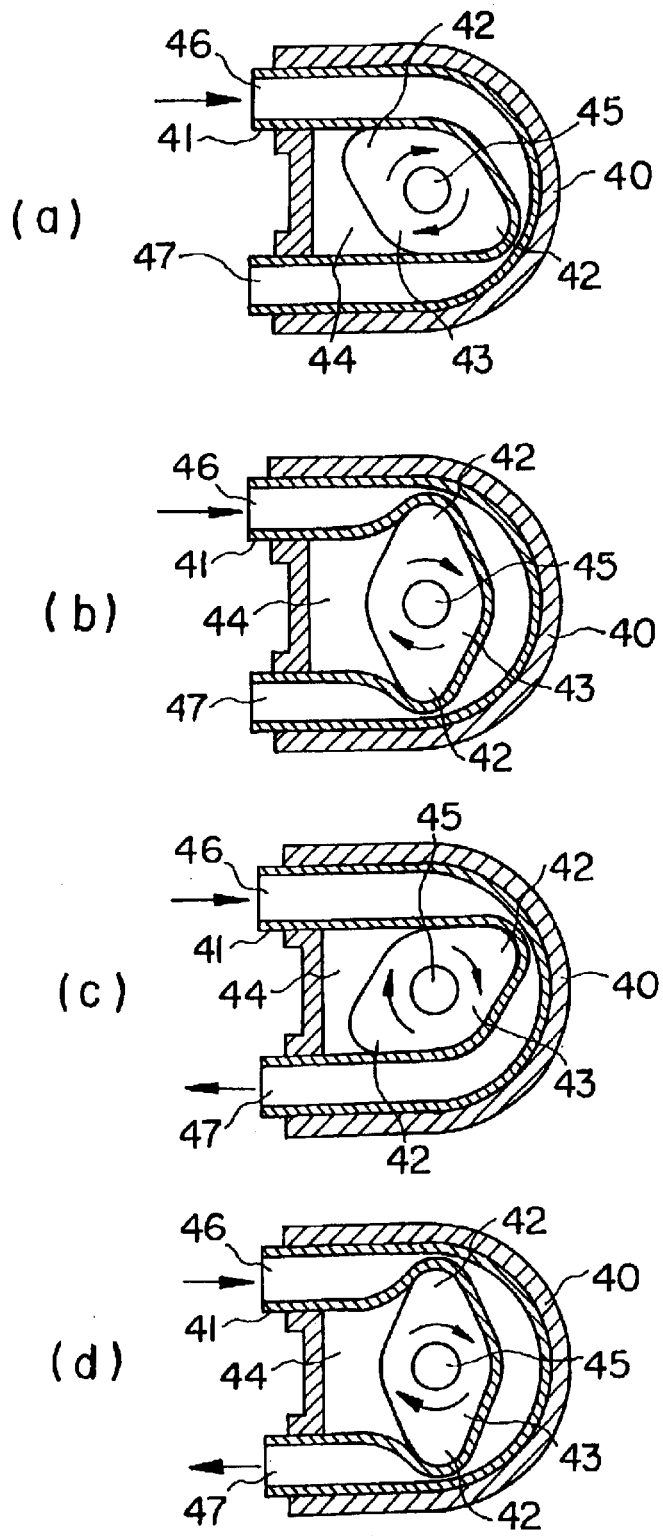

[Fig. 7]
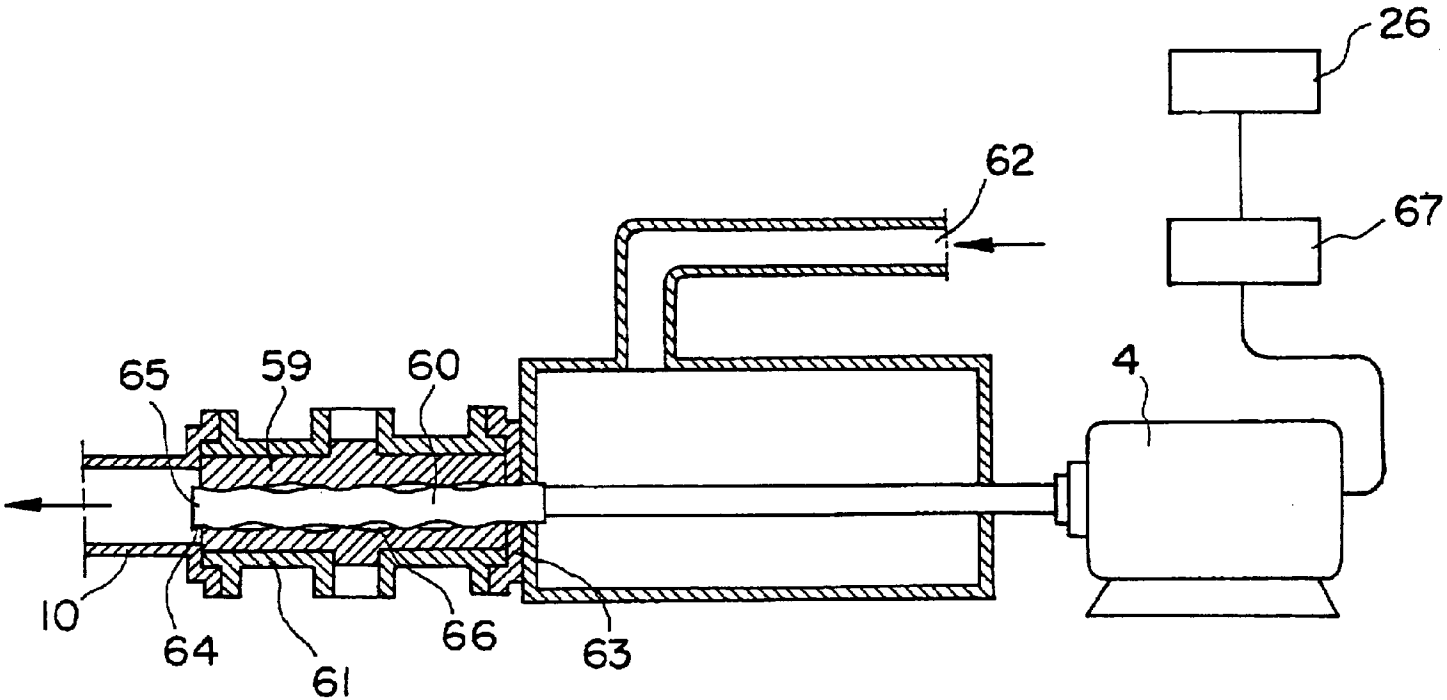

[Fig. 8]
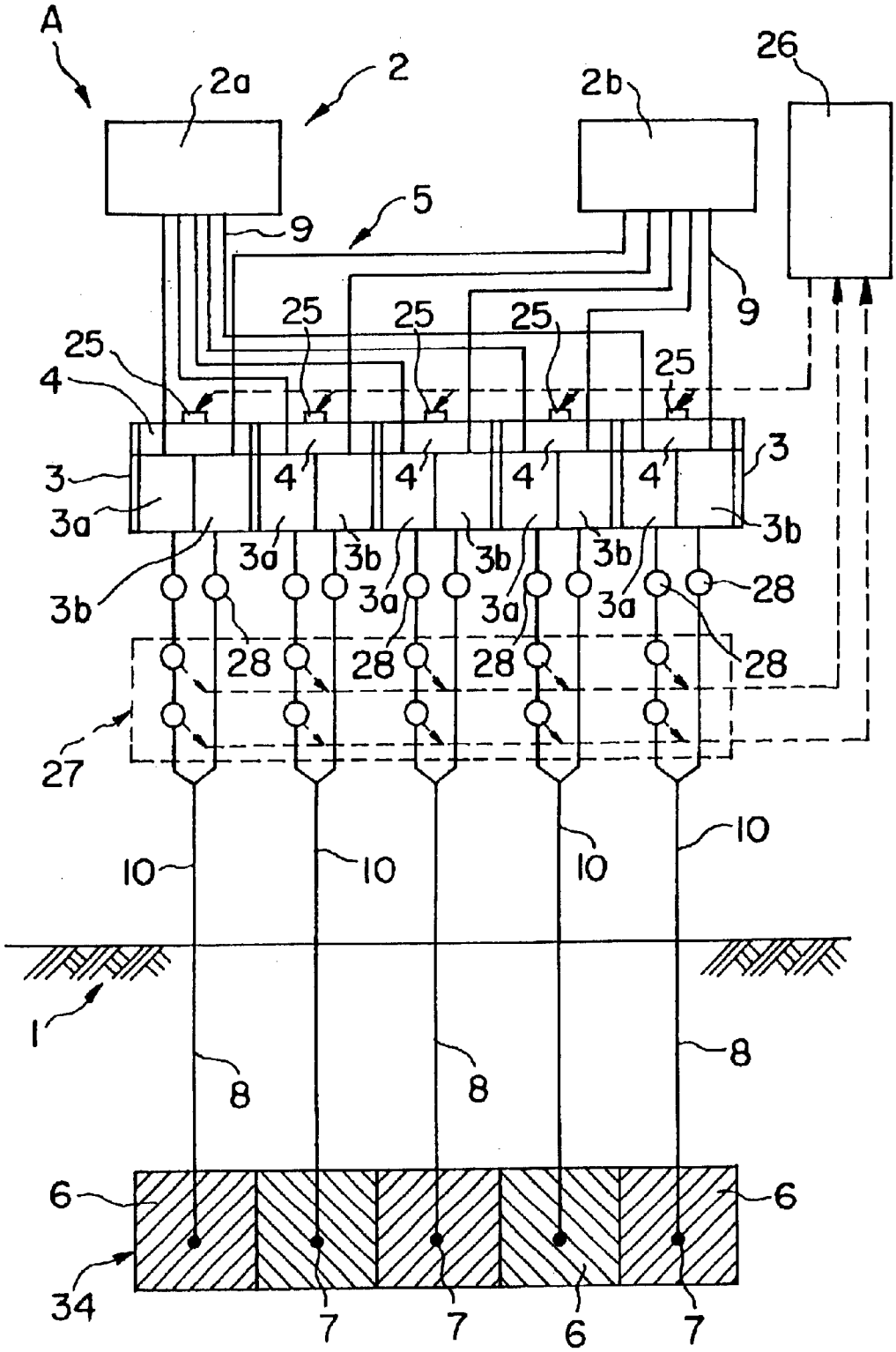

[Fig. 9]
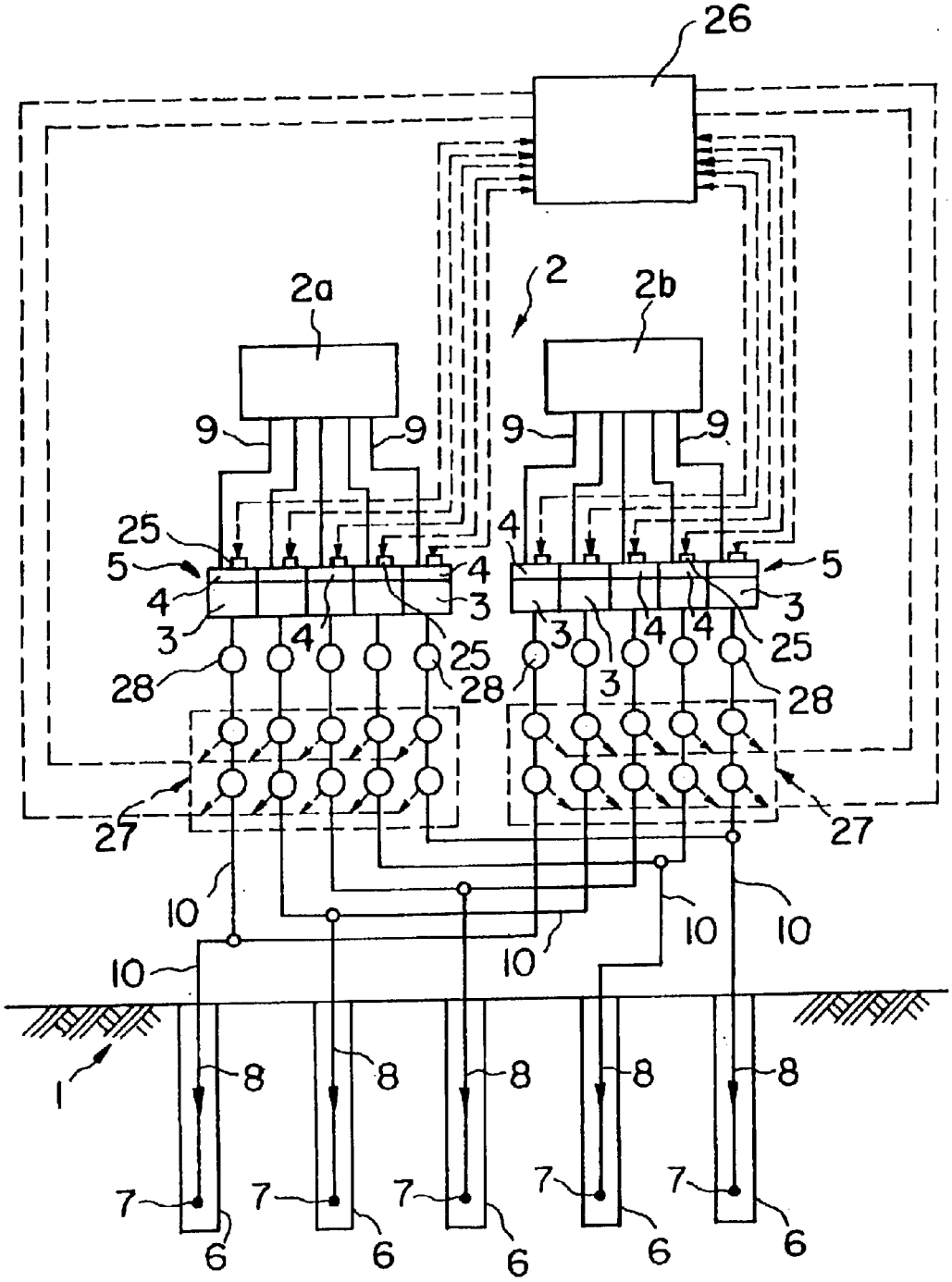

[Fig. 10]
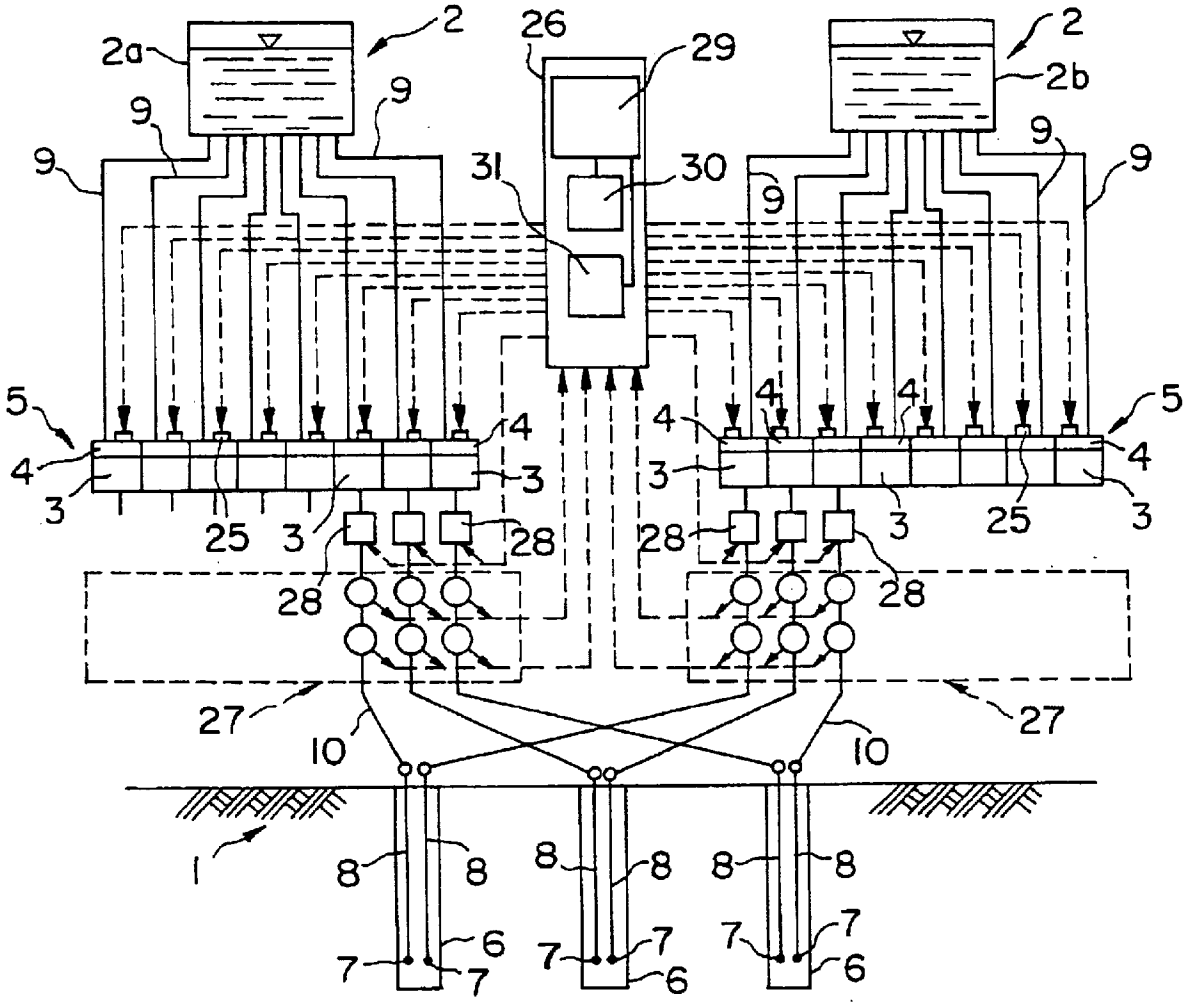

[Fig. 11]

| watching screen | | | time 20 minutes |
|---|---|---|---|
| 01~05 *1 | 01~05 *2 | 06~10 *1 | 06~10 *2 |
| 01– integral 123.4L | 01– maximum pressure 1.23MPa | 06– integral 123.4L | 06– maximum pressure 1.23MPa |
| 02–integral 123.4L | 02–maximum pressure 1.23MPa | 07– integral 123.4L | 07– maximum pressure 1.23MPa |
| 03–integral 123.4L | 03–maximum pressure 1.23MPa | 08– integral 123.4L | 08– maximum pressure 1.23MPa |
| 04– integral 123.4L | 04–maximum pressure 1.23MPa | 09– integral 123.4L | 09– maximum pressure 1.23MPa |
| 05–integral 123.4L | 05–maximum pressure 1.23MPa | 10– integral 123.4L | 10– maximum pressure 1.23MPa |
| 01~05 flow rates/pressure | | 06~10 flow rates/pressure | |
| | 01 *3 10.5L | | 06 *3 10.5L |
| | 01 pressure 1.00MPa | | 06 pressure 1.00MPa |
| | 02 *3 10.5L | | 07 *3 10.5L |
| | 02 pressure 1.00MPa | | 07 pressure 1.00MPa |
| | 03 *3 10.5L | | 08 *3 10.5L |
| | 03 pressure 1.00MPa | | 08 pressure 1.00MPa |
| | 04 *3 10.5L | | 09 *3 10.5L |
| | 04 pressure 1.00MPa | | 09 pressure 1.00MPa |
| | 05 *3 10.5L | | 10 *3 10.5L |
| | 05 pressure 1.00MPa | | 10 pressure 1.00MPa |

*1 : integrated flow rates

*2 : maximum pressure

*3 : flow rates

[Fig. 12]
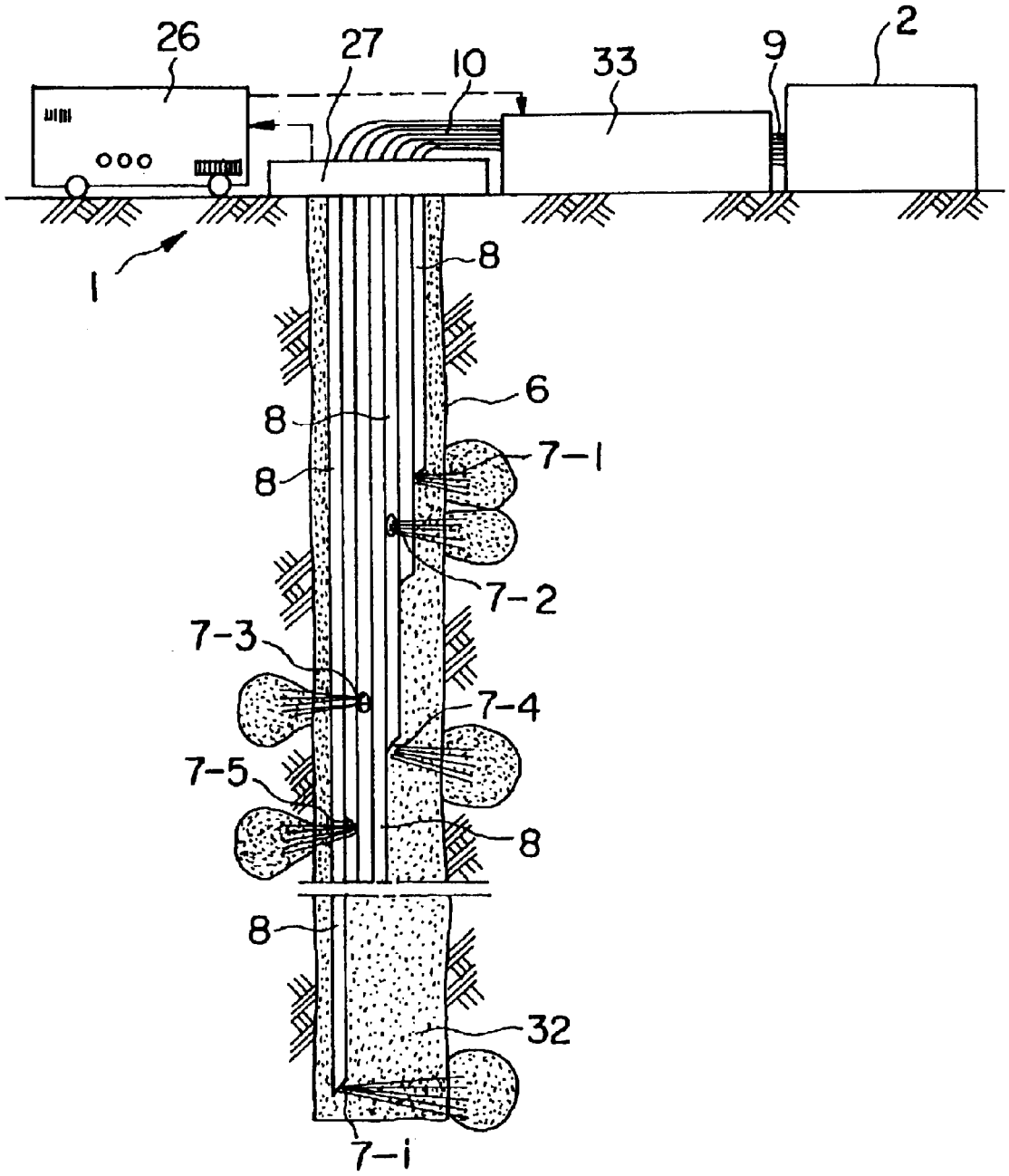

[Fig. 13]
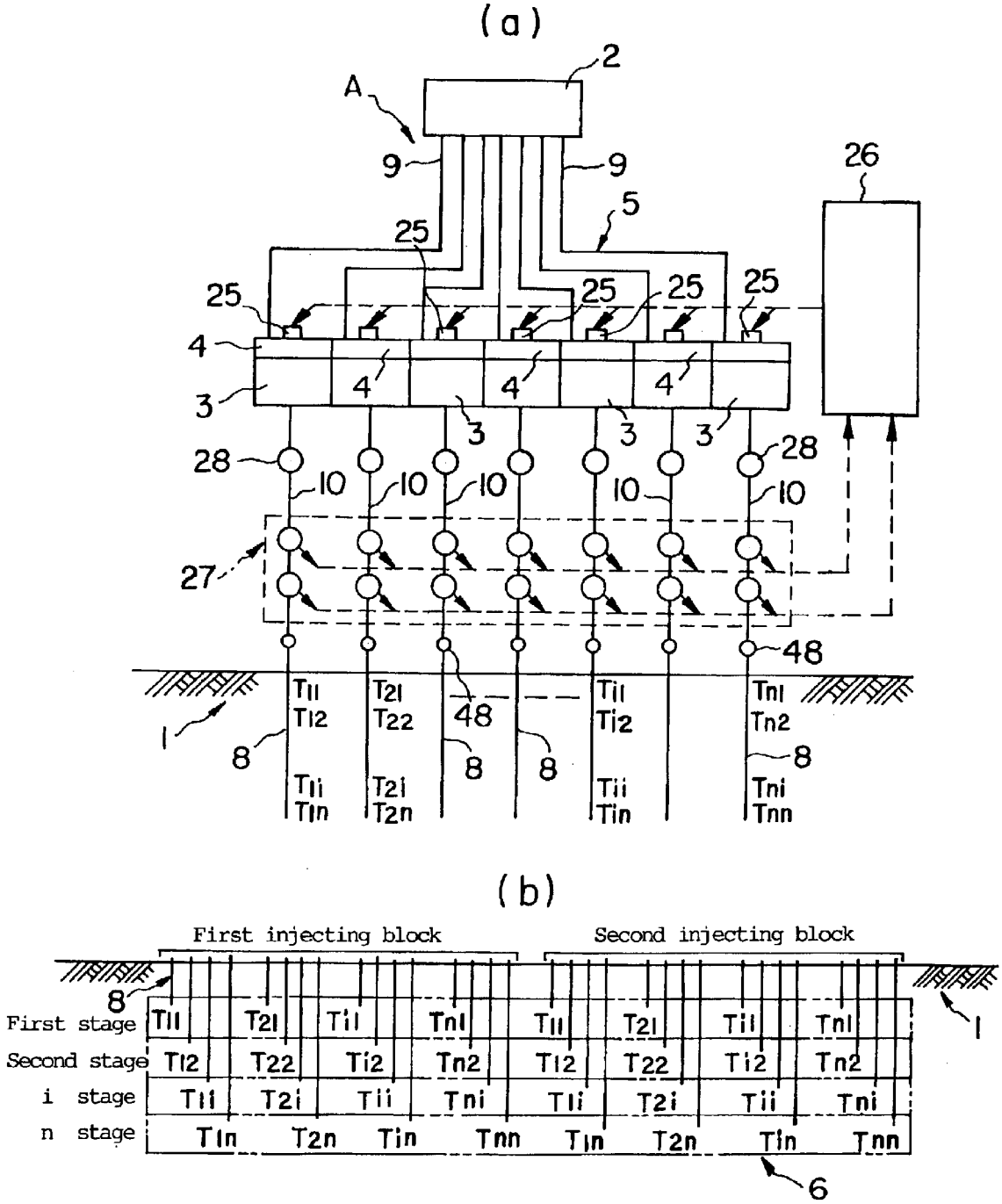

MULTIPOINT GROUTING METHOD AND APPARATUS THEREFOR

BACKGROUND OF THE INVENTION

1. Field of the Invention

The present invention relates to a multipoint grouting method for effecting multipoint-injection of a ground improving material into ground to be improved such as weak ground, soft ground, flimsy ground, loose ground or the like, and an apparatus therefor. In particular, it relates to a multipoint grouting method and an apparatus therefor which are not only capable of, with respect to ground having soil layers different from each other in soil condition, concurrently or selectively applying optimum injection to each of the soil layers but also capable of one-, two- or three-dimensionally injecting a ground improving material into ground, and which are further capable of flexibly controlling injection from a plurality of injection pipes and capable of carrying out injection concurrently from the plurality of the injection pipes to thereby increase reliability of permeation grouting into a very fine-grained soil layer and to thereby enable a shortened execution period to be realized by rapid execution.

The term "ground improving material" used herein means a ground solidifying injection material for strengthening ground to be improved such as weak ground, soft ground, flimsy ground or the like or for solidifying such ground to cut off water, an injection material (grouting material) for solidifying an environmental pollutant such as industrial wastes, a solidifying material for forming a cut-off layer to prevent leakage of a deleterious substance from an environmental pollutant, an injection material (grouting material) containing a chemical substance for rendering an environmental pollutant nonpolluting, a heavy metal immobilizing material for chemically inactivating a heavy metal, or the like.

2. Description of the Prior Art

In general, ground has soil layers which are different from each other in coefficient of water permeability, porosity or the like, and thus the soil layers are different from each other in soil condition such as soil texture. In injection of a grouting material (injection material) into ground of such a type, heretofore, a single injection pipe has been inserted or a plurality of injection pipes have been inserted at intervals into the ground, and the grouting material has been sequentially injected into the layers of the ground by upward or downward moving an injection stage, although the system is not shown.

The most challenging problems in injection of a grouting material into ground are permeation of the grouting material into a very fine sand layer which has a low coefficient of water permeability and uniform permeation of the grouting material into ground having soil layers different from each other in soil condition.

Generally, coefficient of water permeability, which is represented by k, into a very fine sand layer is such that k=10−3 to 10−4 cm/sec. In order to inject a grouting material into such a soil layer without causing ground breakage, it is necessary in terms of permeation theory that the grouting material be injected under low pressure at a delivery rate of lower than 1 liter to several liters per minute.

In the above-described known injection method, however, since one set of injection pumps is used for each injection pipe, the grouting material is injected inevitably at a delivery rate of 10 to 20 liters per minute because of economical need to minimize a work period and of performance limit of the pump. Accordingly, the injection pressure is high, and thus ground breakage is likely to be caused. This gives rise to ground protuberance, insufficient permeation of the grouting material into a very fine-grained soil layer which leads to insufficient solidification of the soil layer, or the like.

In injection of a grouting material into ground having soil layers different from each other in soil condition such as soil texture, when a soil layer which is subjected to the injection is changed from one to another, it is practically difficult to change delivery rate or to control amount of the grouting material to be injected in response to the change of the soil layer which is subjected to the injection. Accordingly, it is likely that the grouting material spreads throughout one soil layer in a large amount but permeates into another soil layer only in a slight amount. In such injection, there is a problem that continuity between the neighbouring solidified soil layers is not obtained.

Further, a patent application previously filed by the present inventor has been published as Japanese Unexamined Patent Publication No.2000-45259. According to the publication, a plurality of injection pipes are inserted in ground, and a ground improving material is injected into the ground from outlets of the injection pipes in such a manner that the ground improving material is delivered under pressure to the injection pipes and injected from the outlets into the ground by means of a multiple pump (pump plant) comprising a plurality of unit pumps which are concurrently operated by a single driving means.

In the above-described known technique, there is a problem as follows. Since the injection slender pipes are required to extend over a long distance from the multiple pump (pump plant) to the outlets, it is necessary to use a grouting fluid having a low viscosity and a long gelation time. However, if a grouting fluid having a long gelation time once flow out of an intended area to the ground surface or a coarse-grained soil layer in ground, it is inevitable to suspend the injection because no meansures to shorten the gelation time are provided. During the suspension, the grouting fluid disadvantageously gelatinizes in the injection slender pipes.

Further, the unit pumps constituting the multiple pump are concurrently driven by the single driving means. Consequently, all the unit pumps are driven under the same conditions although ground conditions are different at the outlets and thus optimum grouting conditions are different with respect to the outlets. Accordingly, it is impossible to carry out optimum grouting with respect to each of the outlets.

SUMMARY OF THE INVENTION

It is, therefore, an object of the present invention to provide a multipoint grouting method and an apparatus therefor which overcome the above-described drawbacks inherent in the known techniques and which are capable of, while utilizing the advantage of a multipoint grouting pump (multiple pump) that has already been developed for permeation grouting of a grout under low pressure into a wide area of ground, flexibly controlling delivery rate, injection pressure, suspension or discontinuation of injection, resumption of injection, gelation time with respect to each of unit pumps according to the state of injection through each of grout injection pipes, and which are capable of concurrently controlling operations of the plurality of the unit pumps and capable of en masse monitoring and controlling states of injection.

It is another object of the present invention to provide a multipoint grouting method and an apparatus therefor which are capable of checking flowing of a grout having a long gelation time out of an intended injection area by injecting a grout having a short gelation time when the flowing out arises during injection such as rough injection in the primary injection or the like, and to thereby greatly improve utility of multipoint injection by means of a multiple injection means.

It is still another object of the present invention to provide a multipoint grouting method and an apparatus therefor which overcome the above-described drawbacks inherent in the known techniques and which are not only capable of concurrently or selectively applying optimum injection at variable delivery rates of lower than 1 to sevearal liter/min to very fine-grained soil layers having low water permeabilities or ground having soil layers different in soil condition such as soil texture but also capable of carrying out injection of a ground improving material into ground one-, two- or three-dimensionally, and by virtue this, which increase reliability of permeation grouting into a very fine-grained soil layer and which enable a shortened execution period to be realized by rapid execution.

It is a further object of the present invention to provide a multipoint grouting method and an apparatus therefor which overcome the above-described drawbacks inherent in the known techniques and which permit not only use of a solution type grout but also use of a suspension type grout and is thereby capable of flexibly selecting desired injection according to ground condition in each of injection points.

To attain the above-described objects, according to the present invention, there is provided a multipoint grouting method comprising:

inserting a plurality of injection pipes each having an outlet in a plurality of injection points in ground; and concurrently or selectively injecting a ground improving material, via the injection pipes, from the plurality of the outlets into the plurality of injection points;

wherein a multiple injection means is used which includes a plurality of unit pumps driven by driving means independent of each other and controlled by a centralized control means, and the plurality of the unit pumps are connected through ducts to the plurality of the injection pipes, and by operations of the plurality of the unit pumps, the ground improving material is injected from the plurality of the outlets into the plurality of the injection points in the ground.

To attain the above-described objects, according to the present invention, there is further provided a multipoint grouting apparatus comprising:

a reservoir for a ground improving material;

a multiple injection means including a plurality of unit pumps (in one plant) and connected to the reservoir, each of said unit pumps being driven by an independent driving means and controlled by a centralized control means;

a plurality of injection pipes inserted in a plurality of injection points in ground and connected to the respective unit pumps through ducts, said injection pipes each having an outlet;

(a plurality of) rotational speed changing means which are provided for the independently driven respective unit pumps and which are controlled by the centralized control means; and (a plurality of) flow rate and pressure sensors provided in mid-courses of the respective ducts;

said flow rate and pressure sensors transmitting data signals on flow rates and/or pressures to the centralized control means to deliver under pressure the ground improving material in the reservoir to each of the injection pipes by the operation of each of the unit pumps at a desired injection rate, under desired injection pressure (and/)or in a desired amount of injection, thereby injecting the ground improving material concurrently (or selectively) from the plurality of the outlets into a plurality of injection points in the ground.

The above-mentioned rotational speed changing means are en masse controlled by the centralized control means. Accordingly, the plurality of the unit pumps, on one hand, have functions of independently optimally injecting a grout into the respective injection points and, on the other hand, constitute a single multiple injection means which en masse controls the injection into the plurality of the injection points.

BRIEF DESCRIPTION OF THE DRAWINGS

FIG. 1 is an illustrative view showing a basic embodiment of the apparatus according to the present invention;

FIG. 2 is a schematic view showing principle of a conventional piston pump;

FIG. 3 is a schematic view showing principle of a plunger pump used as the unit pump in the present invention;

FIG. 4 is a sectional view of a specific example of a plunger pump as the unit pump used in the present invention.

FIG. 5 is a sectional view of a diaphragm pump as the unit pump used in the present invention;

FIGS. 6(*a*) to 6(*d*) are sectional views of a squeeze pump as the unit pump used in the present invention, which illustrate operation of the squeeze pump;

FIG. 7 is an illustrative view of a snake pump as the unit pump used in the present invention;

FIG. 8 is a system diagram of another embodiment of the apparatus according to the present invention.

FIG. 9 is a system diagram of still another embodiment of the apparatus according to the present invention;

FIG. 10 is a system diagram of a further another embodiment of the apparatus according to the present invention;

FIG. 11 is an example of representation of data displayed on an injection monitor of a centralized control means;

FIG. 12 is a system diagram of a still further embodiment of the apparatus according to the present invention, which uses injection pipes each comprised of a plurality of slender pipes; and FIGS. 13(*a*) and 13(*b*) are a system diagram of another embodiment of the apparatus according to the present invention and a diagrammatic view showing arrangement of injection pipes in an injection point, respectively.

DESCRIPTION OF THE PREFERRED EMBODIMENTS

In the following, the present invention will be described in detail with reference to the drawings.

The multipoint grouting apparatus A according to the present invention which is shown in FIG. 1 comprises a reservoir 2 for a ground improving material, a multiple injection means 5 which has a plurality of unit pumps 3, 3 . . . 3 driven by independent driving means 4, 4 . . . 4 such as motors and connected to and controlled by a centralized control means 26 and which is connected to the reservoir 2 through each of ducts 9, 9 . . . 9, and a plurality of injection pipes 8, 8 . . . 8 which is inserted in injection points 6, 6 . . . 6 and which is connected to the respective unit pump 3, 3 . . . 3 through ducts 10, 10 . . . 10 and each of which has an outlet 7.

The above-mentioned plurality of the independent unit pumps 3, 3 . . . 3 are provided with rotational speed changing means 25, 25 . . . 25 (such as inverters) connected to and controlled by the centralized control means 26, and the ducts 10, 10 . . . 10 which connect the unit pumps 3, 3 . . . 3 to the injection pipes 8, 8 . . . 8 are provided, in mid-courses thereof, with flow rate and pressure sensors 27, 27 . . . 27 each of which is connected to and controlled by the centralized control means 26. As each of the injection pipes 8, 8 . . . 8, a Y-shaped pipe may be used.

With the above-described structure, in the present invention, signals on flow rate and/or pressure data are transmitted from the flow rate and pressure sensors 27, 27 . . . 27 to the centralized control means 26, and by operations of the unit pumps 3, 3 . . . 3, a ground improving material in the reservoir 2 is delivered under pressure to the injection pipes 8, 8 . . . 8 at a desired flow rate, under desired injection pressure, (and/)or in a desired amount and injected concurrently form the plurality of the outlets 7, 7 . . . 7 into the plurality of the injection points 6, 6 . . . 6 in ground 1, and an injected area 34 is thereby formed.

As the unit pump 3 used in the present invention, there may be mentioned a piston pump, a plunger pump, a diaphragm pump, a squeeze pump, a snake pump or the like. Exclusive of a piston pump, any of these kinds of pumps are small-sized and less trouble-prone and have simple structures, and by virtue of this, these kinds of pumps permit not only use of a solution type grout but also use of a suspension type grout and are suitable for the unit pump used in the present invention. In particular, various kinds of pumps shown in FIGS. 3 to 7 are small-sized and light-weight and less trouble-prone and have low delivery rates and gentle pulses and simple structures, and accordingly, these kinds of pumps permit not only use of a solution type grout but also use of a suspension type grout and are suitable for the unit pump used in the present invention.

FIG. 2 is a schematic view showing principle of a piston pump 68. It comprises a plunger 12, and a crank 16 which is connected to the plunger 12 via a piston rod 13 and a crank shaft 14 and which rotates with rotations of a rotating shaft 15. As described above, it is capable of injecting a grout at a high delivery rate under high pressure, but it has strong pulses and is large-sized and heavyweight.

FIG. 3 is a schematic view showing principle of a plunger pump 11 used as the unit pump 3 in the present invention. As shown in FIG. 3, the plunger pump 11 comprises a crank 16 which rotates with rotations of a rotating shaft 15, and a plunger 12 which is so contained in a cylinder 18 filled with gland packing 17 as to be permitted to reciprocate and which is connected to the crank 16 via a connecting rod 19. Below the plunger 12, the cylinder 18 is connected to a suction hose 21 and a delivery hose 22 via a duct 20.

In operation of the plunger pump 11, first, the crank 16 rotates with rotations of the rotating shaft 15 to push the plunger 12 in the forward direction, i.e., upward direction. By this movement, the ground improving material in the reservoir 2 shown in FIG. 1 is sucked through the suction hose 21 shown in FIG. 3 while opening a ball valve 23 in an amount corresponding to the amount of the movement of the plunger 12. Then, the crank 16 further rotates with rotations of the rotating shaft 15 to push the plunger 12 in the backward direction, i.e., downward direction. By this movement, the ground improving material which has been sucked is pushed and fed to the delivery hose 22 while closing the ball valve 23 and opening a ball valve 24 and delivered under pressure to the injection pipe 8 through the duct 10 shown in FIG. 1 and injected into the injection point 6 in the ground 1. By the use of the multiple injection means 5 including the plurality of the unit pumps 3, 3 . . . 3, the ground improving material is injected into the plurality of the injection points 6, 6 . . . 6 in the ground 1.

FIG. 4 is a sectional view of a specific example of a plunger pump 11 as the unit pump 3 used in the present invention. As in the case of FIG. 3, the plunger pump 11 comprises a crank 16 which rotates with rotations of a rotating shaft 15, and a plunger 12 which is so contained in a cylinder 18 filled with a gland packing 17 as to be permitted to reciprocate and which is connected to the crank 16 via a connecting rod 19. Below the plunger 12, the cylinder 18 is connected to a suction hose (pipe) 21 and a delivery hose (pipe) 22 via a duct 20.

In FIG. 4, reference number 35 represents a fluid container in the suction system, and the fluid container 35 is covered with a cap 36. Reference number 37 represents a fluid container in the delivery system, and as in the case of the above-mentioned fluid container 35, the fluid container 37 is covered with a cap 38. Reference number 39 represents a fixing piece for the caps 36 and 38.

In operation of the plunger pump 11, as in the case of FIG. 3, first, the crank 16 rotates with rotations of the rotating shaft 15 to push the plunger 12 in the forward direction, i.e., upward direction. By this movement, the ground improving material in the reservoir 2 shown in FIG. 1 is sucked through a suction hose 21 shown in FIG. 3 while opening a ball valve 23 in an amount corresponding to the amount of the movement of the plunger 12 and contained in the fluid container 35. Then, the crank 16 further rotates with rotations of the rotating shaft 15 to push the plunger 12 in the backward direction, i.e., downward direction. By this movement, the ground improving material which has been sucked into the fluid container 35 is pushed and fed to the delivery hose 22 through portions 20*a* and 20*b* of the duct 20 and then the fluid container 37 while closing the ball valve 23 and opening a ball valve 24 and delivered under pressure to the injection pipe 8 through the duct 10 shown in FIG. 1 and injected into the injection point 6 in the ground 1. By the use of the multiple injection means 5 including the plurality of the unit pumps 3, 3 . . . 3, the ground improving material is injected into the plurality of the injection points 6, 6 . . . 6 in the ground 1.

FIG. 5 is a sectional view of a diaphragm pump as the unit pump 3 used in the present invention. The diaphragm pump comprises a wobble plate 50 which is mounted on a shaft 49 with its axis oblique relative to the axis of the shaft 49 and which rotates with rotations of the shaft 49, and a piston 53 of which one end is in contact with a plate surface 50*a* of the wobble plate 50 and which is provided with a diaphragm 51 at the other end thereof and which is operated under elestic force of a spring 52, and a space 56 which is formed contiguously to the diaphragm 51 of the piston 53 and which has an inlet 54 and an outlet 55 for the ground improving material.

The diaphragm pump constructed as described above have a simple structure and is small-sized, and in its operation, the shaft 49 is rotated to thereby rotate the wobble plate 50. Since the wobble plate 50 is mounted on the shaft 49 with its axis oblique relative to the axis of the shaft 49, the shaft 49 is rotated with its plate surface 50*a* inclined. When the inclined plate surface 50*a* is rotated, the piston 53 of which one end is in contact with the plate surface 50*a* is moved to-and-fro under elastic force of the spring 52. At this time, the diaphragm 51 at the other end of the piston 53 is also moved to-and-fro and is thereby alternately rendered convex and concave. By this movement, the ground improving material is introduced from the inlet 54 through a valve 57 into the space 56 and sent through a valve 58 to the outlet 55 and discharged therefrom. The introduction and the discharge are repeated. Incidentally, both of the valves 57 and 58 are check valves.

FIGS. 6(*a*) to 6(*d*) are sectional views of a squeeze pump as the unit pump 3 used in the present invention, which illustrate operation of the squeeze pump. The squeeze pump comprises a drum 40, a pumping tube 41 made of an elastic material such as a rubber and placed in the drum 40 along the inner surface of the drum 40, and a rotor 43 having pumping rollers 42, 42 at its both ends is provided rotatably about a rotating shaft 45 in a pump chamber 44 defined inside the pumping tube 41.

In operation of the squeeze pump, the ground improving material is sucked in the direction shown by the arrow and introduced into the pumping tube 41 from an inlet 46 of the pumping tube 41, and the rotor 43 is further rotated by rotations of the rotating shaft 45 from the state shown in FIG. 6(*a*). The ground improving material is thereby sent, while pressing the pumping rollers 42, 42 against the pumping tube 41 as shown in FIG. 6(*b*), to an outlet 47 and discharged in the direction shown by the arrow as shown in FIGS. 6(*c*) and 6(*d*) in a manner similar to squeezing toothpaste from a tube. The portions of the pumping tube 41 from which the ground improving material has been squeezed restore to the original states by restoring force of the elastic material such as a rubber itself. At this time, suction force reaches 740 mmHg in terms of degree of vacuum, and the maximum delivery pressure is as high as 30 kgf/cm2. The squeeze pump of this type is capable of delivering under pressure a slurry having a high viscosity or high concentration or containing solidified matter, or a mud-like material.

FIG. 7 is an illustrative view of a snake pump as the unit pump 3 used in the present invention. The snake pump comprises a stator 59 which is internally double-threaded, a rotor 60 which is rotatable while being in contact with the inner surface of the stator 59 and which is provided with an external single thread having a pitch that is the half of the pitch of the internal double thread, and a housing 61 accommodating the stator 59 and the rotor 60, and the snake pump is provided with an inlet 62 for introducing the ground improving material form one end 63 of the housing 61 into gaps between the stator 59 and the rotor 60, and an outlet 65 for discharging the ground improving material from the other end 64 of the housing 61.

In other words, the snake pump shown in FIG. 7 basically comprises the stator 59 fixed in the housing 61 and the rotor 60 having a snake-like shape. The stator 59 is provided with short grooves of which both ends are semicircular in the form of special internal double thread, and inside the stator 59, the rotor 60 provided with the external single thread is rotated around the axis of the stator 59 while maintaining the eccentric distance of e mm and being rotated on its axis. However, since the small grooves of the stator 59 form walls, the movement of the rotor 60 is vertical at the 0 degree posotion and horizontal at the 90 degree psition. When the rotor 60 (viewed from the front) is counterclockwise rotated two times, the ground improving material is advanced in the gaps 66 in the stator 59 and introduced through a duct 10 into an injection pipe (not shown).

The relationship between the stator 59 and the rotor 60 is such that flow of the grouting fluid is put in an effectively conditioned environment from the inlet 62 to the outlet 65 at any rotational position in each stage and continuous operation is performed smoothly. In this manner, the threaded surfaces effectively engage with each other. Accordingly, when the rotor 60 is rotated, no substantial pulses are caused and the amount of the grouting fluid is constant with respect to any cross-sections of the stator 59 and delivery rate always corresponds to number of rotations just as results from slow travel of a piston in a cylinder having an infinite length in one direction. In other words, advantages of a snake pump are resides in that (1) it has a structure which permits continuous delivery under pressure and is thus substantially noize-free and causes no substantial pulses, that (2) a constant delivery rate corresponding to the number of rotations is ensured, that (3) since it has no valve means, a ground improving material having a high viscosity and a high concentration can be delivered even if bubbles are contained therein, that (4) since a rotor can instantaneously be rotated, stopped or reversely rotated, a snake pump may be used in conjunction with an automatic contrlol means, and that (5) a stator 59 and a rotor 60 may be replaced with ease.

In general, the unit pumps as described above are used as members of a set comprising 5 to 100 members which constitutes a multiple injection means. In the one set, the unit pumps are arranged one-dimensionally, two-dimensionally or three-dimensionally. Each of the unit pumps is driven by a driving means such as a motor. Each of the driving means is operated by a rotational speed changing means, such as an inverter, which is controlled by the centralized control means. Accordingly, it is necessary for the multiple injection means in one plant that the plurality of the independent unit pumps are supported by a support such as a pedestal, a frame or the like or compactly stacked to prevent vibrations, deformation or distortion attributable to the operations of the plurality of the driving means.

In the present invention, for example, unit pumps 3 of 30 cm×30 cm×20 cm are arranged in such a manner that the unit pumps are supported by a support such as a frame or the like or compactly stucked 4 in number in the row direction×4 in the column direction and 3 in the height direction. As a result, the 48 unit pumps are arranged into a multiple injection means 5 having a size of 1.2 m×1.2 m×0.9 m at the minimum. Accordingly, the multiple injection means in the present invention includes 48 unit pumps but the unit pumps may be arranged into a compact single injection means having a small volume as a whole. When a plunger pump is used as each of the unit pumps constituting a single multiple injection means, each unit pump has delivery pressure of 4 to 7 MPa at 50 Hz and a delivery rate of 1 to 7 liter/min at 50 Hz and a volume as small as 30 cm×30 cm×20 cm. While each unit pump having a delivery rate from its outlet 7 of 1 to 7 liter/min is so operated by the inverter in accordance with the directions from the centralized control means as to maintain optimum injection rate and optimum injection pressure with respect to the predetermined injection point, the injection as a whole from the plurality (for example, 50) of the outlets at a total delivery rate within a range of (1 to 7 liter/min)×50=50 to 350 liter/min is en masse controlled by the centralized control means. This enebles performing permeation into particles at a low delivery rate under low pressure and enables a shortened execution period to be realized by rapid execution.

FIG. 8 is a system diagram of another embodiment of the apparatus according to the present invention which uses unit pumps 3, 3 . . . 3 each having a fluid A sucking and delivering section 3*a* and a fluid B sucking and delivering section 3*b*. In the apparatus shown in FIG. 8 is substantially the same as the apparatus shown in FIG. 1 except that a reservoir 2*a* for a fluid A and a reservoir 2*b* for a fluid B are used as an alternative to the single reservoir 2 for a ground improving material and that as alternative to the unit pumps 3, 3 . . . 3 shown in FIG. 1, there are used the unit pumps 3, 3 . . . 3 each having a fluid A sucking and delivering section 3*a* connected to the fluid A reservoir 2*a* via a duct 9 and a fluid B sucking and delivering section 3*b* connected to the fluid B reservoir 2*b* via a duct 9. Each unit pump 3 is operated by a driving means 4 under control of a rotational speed changing means 25 which are common to the fluids A and B so that the fluid A and the fluid B are delivered from the fluid A sucking and delivering section 3*a* and the fluid B sucking and delivering section 3*b* in a constant ratio therebetween at a predetermined flow rate.

In carrying out, using the above-described apparatus according to the present invention, multipoint injection of the ground improving materials into injection points 6, 6 . . . 6 in ground 1 through outlets 7, 7 . . . 7 of injection pipes 8, 8 . . . 8, the fluid A and the fluid B are separately introduced from the reservoir 2*a* and the reservoir 2*b* through the unit pumps 3, 3 . . . 3 of multiple injection means 5 into the injection pipes 8, 8 . . . 8 and joined together and then injected under pressure concurrently into a plurality of the injection points 6, 6 . . . 6 in ground 1.

FIGS. 9 and 10 are system diagrams of still another embodiment and a further embodiment of the apparatus according to the present invention, respectively. Each of the embodiments basically comprises a reservoir 2 for ground improving materials, a multiple injection means 5, and a plurality of injection pipes 8, 8 . . . 8. The reservoir 2 for ground improving materials includes a fluid A reservoir 2*a* and a fluid B reservoir 2*b*, and a fluid A and a fluid B contained in the reservoirs are separately introduced into an injection pipe 8 and joined together. In this connection, in the apparatus shown in FIG. 9, the fluids A and B are joined together in a duct 10 and then delivered under pressure to the injection pips 8 and injected from an outlet 7 into an injection point 6. On the other hand, in the apparatus shown in FIG. 10, two injection pipes 8, 8 are inserted in each injection point 6 in ground 1, and the fluid A and the fluid B are separately delivered under pressure to the respective injection pipes 8, 8 and injected from outlets 7, 7 into the injection point 6, and after the injection, the fluids A and B are joined together and reacted with each other in the ground 1. In this connection, in the apparatus shown in FIG. 10, these different kinds of the ground improving materials may be injected concurrently or with time difference. In this regard, the apparatus shown in FIGS. 9 and 10 are different from each other. Further, the two injection pipes 8, 8 may be inserted in different injection points 6, 6 distant from each other. In this case, the fluids A and B are injected from the respective outlets 7, 7 into the ground 1 and joined together in the ground 1 and reacted with each other in the ground.

In one plant, the multiple injection means 5 comprises a plurality of unit pumps 3, 3 . . . 3 independent from each other which are operated together as one injection set by independent driving power sources 4, 4 . . . 4 such as motors under control of a centralized control means 26 and of which one group and the other group are respectively connected to the fluid A reservoir 2*a* and the fluid B reservoir 2*b* via ducts 9, 9 . . . 9. The unit pumps 3, 3 . . . 3 are used 5 or more in number, and these unit pumps are arranged in a row to form a multiple injection means, as shown in FIGS. 9 and 10. However, the unit pumps may be arranged in a row in a direction different from those shown in FIGS. 9 and 10, and further, the unit pumps may be arranged two- or three-dimensionally. As a specific example of the unit pump 3, there may be mentioned a plunger pump 11 as shown in FIG. 3 or FIG. 4, a diaphragm pump as shown in FIG. 5, a squeeze pump as shown in FIG. 6, a snake pump as shown in FIG. 7, and the like.

Each of the injection pipes 8, 8 . . . 8 is provided with an outlet 7 at its distal end, and the plurality of the injection pipes 8, 8 . . . 8 are implanted into the plurality of the injection points 6, 6 . . . 6. In the apparatus shown in FIG. 9, each of the injection pipes 8, 8 . . . 8 is connected to both of the unit pump 3 in communication with the fluid A reservoir 2*a* and the unit pump 3 in communication with the fluid B reservoir 2*b*. In the apparatus shown in FIG. 10, one group and the other group of the injection pipes 8, 8 . . . 8 are respectively connected to the one group of unit pumps 3, 3 . . . 3 in communication with the fluid A reservoir 2*a* and the other group of the unit pumps 3, 3 . . . 3 in communication with the fluid B reservoir 2*b*.

Further, each of the above-described plurality of independent unit pumps 3, 3 . . . 3 is provided with a rotational speed changing means 25. Each of the rotational speed changing means 25, 25 . . . 25 is connected to a centralized control means 26 and controlled by the centralized control means 26 (in the drawings, the connections therebetween are shown in dashed lines). Accordingly, the fluid A and the fluid B as ground improving materials in the fluid A reservoir 2*a* and the fluid B reservoir 2*b* are delivered under pressure by the operations of the unit pumps 3, 3 . . . 3 at desired flow rates through the ducts 10 to the injection pipes 8, 8 . . . 8 and injected from the outlets 7, 7 . . . 7 into the plurality of the injection points in the ground 1. In this connection, in the apparatus shown in FIG. 9, the fluids A and B join together in the ducts 10. On the other hand, in the apparatus shown in FIG. 10, the fluids A and B join together after the injection thereof into the ground 1. It should be noted that the multipoint injection may be carried out with the outlets 7, 7 . . . 7 located coplanarly as shown in FIG. 9 or FIG. 10, or may be carried out with the outlets 7, 7 . . . 7 located at different positions in the depth direction as shown in FIG. 12 or FIG. 13 which will be described below.

Moreover, as shown in FIGS. 9 and 10, a flow rate and pressure sensor 27 is provided for each of the injection pipes 8, 8 . . . 8, for example, in such a manner that the flow rate and pressure sensors 27 are disposed in mid-course of the ducts 10, 10 . . . 10 extending from the unit pumps 3, 3 . . . 3 to the injection pipes 8, 8 . . . 8. Data signals on flow rates and/or pressures of the ground improving materials which are detected by the sensors 27, 27 . . . 27 are transmitted to the centralized control means 26 as shown by dashed lines in FIGS. 9 and 10. As shown in FIG. 10, the ground improving materials are injected from the plurality of independent unit pumps 3, 3 . . . 3 through the plurality of injection pipes 8, 8 . . . 8 into the plurality of injection points in the ground 1 while en masse monitoring the states of the multipoint injection by means of an injection monitor 29 of the centralized control means 26.

The operations of the plurality of unit pumps 3, 3 . . . 3 are controlled by means of the rotational speed changing means 25, 25 . . . 25 based on the data signals on flow rates and/or pressures of the ground improving materials which are transmitted to the centralized control means 26. By virtue of the control, the ground improving materials are kept flowing at desired flow rates and/or under desired pressures and transmitted to the injection pipes 8, 8 . . . 8.

Furthermore, the data signals on flow rates and/or pressures of the ground improving materials which are detected by the flow rate and pressure sensors 27, 27 . . . 27 are transmitted to the centralized control means 26, and the data are displayed on the injection monitor 29 of the centralized control means 26 to thereby en masse monitor the states of the multipoint injection. Based on the monitoring, the multipoint injection is carried out while maintaining the flow rate and/or the injection pressure in each of the injection pipes 8, 8 . . . 8 within a desired range. Further, based on the information as to the above-described data, the injection is completed, suspended, discontinued, continued or resumed. In FIGS. 9 and 10, reference number 28 represents a valve such as a selector valve, a stop valve, a return valve or the like. In this connection, the valves 28, 28 . . . 28 may be connected to and controlled by the centralized control means 26, as shown in FIG. 10 (the same applies to the embodiment shown in FIG. 8).

On the injection monitor 29, there are indicated "time data" such as date (year, month and day) of injection, injection time or the like, "positional data" such as block number of injection block, hole number of injection hole, injection points or the like, and "injection data" such as injection pressure, flow rate (amount of the material flowing per unit time), integrated amount (accumulative amount of the material flowed which is obtained by integrating the flow rate) or the like. These data are recorded in the centralized control means 26. In this manner, the operations of the plurality of the unit pumps 3, 3 . . . 3 in communication with the plurality the injection pipes 8, 8 . . . 8 are optimally controlled according to the states of injection through the respective injection pipes 8, 8 . . . 8, and yet the plurality of the unit pumps 3, 3 . . . 3 are en masse controlled. FIG. 11 is an example of representation of pressures, flow rates and integrated amounts which are obtained as a result of the en masse monitoring with respect to ten injection pipes 8, 8 . . . 8. In the present invention, as the injection pipe 8, an injection pipe of a jacketed double packer type, a sole or simple or pipe or the like may be used instead of a Y-shaped pipe. In FIG. 10, reference numbers 30 and 31 represent a work progress indicating means and a daily operation reporting means, respectively.

FIG. 12 is an illustrative view showing a still further embodiment of the multipoint grouting apparatus according to the present invention. First, a hole is bored in ground 1 by means of a casing pipe (not shown) or the like to form an injection point 6. A plurality of injection pipe elements which together constitute an injection pipe 8 are inserted in the injection point 6, and the injection point 6 is filled with a sealing material 32. Each of the injection pipe elements is a slender pipe having a diameter of several mm and having at its distal end an outlet 7 provided with a check valve (not shown) such as a rubber sleeve. The plurality of the slender pipes which constitute each injection pipe 8 are bound together in such a manner that the outlets 7, 7 . . . 7 thereof are located in depth order at different positions in the axial direction, for example, 7-1, 7-2 . . . 7-i are located sequentially from a lass deep position to a deeper position. A ground improving material in a reservoir 2 is delivered through ducts 9, 9 . . . 9, a set 33 of unit pumps 3, 3 . . . 3, ducts 10, 10 . . . 10, and flow rate and pressure sensors 27, 27 . . . 27 to the injection pipe elements and injected from the outlets 7, 7 . . . 7 into the injection point 6 in ground 1. Each of the unit pumps 3, 3 . . . 3 in the unit pump set 33 is controlled by directions from a centralized control means 26 on the basis of the information from the flow rate and pressure sensors 27, 27 . . . 27.

When the injection point is filled with the sealing material 32, each of the outlets 7, 7 . . . 7 of the plurality of the slender pipes which constitute each injection pipe 8 is provided with a check valve (not shown), and the gap between the injection pipe 8 composed substantially of the plurality of the injection pipe elements and the ground 1 may be filled with the sealing material (hardening material) to form sealing material 32 prior to injection of the ground improving material from the outlets 7, 7 . . . 7. As the check valve, a rubber sleeve, a plug or the like may be used.

As a constituent of the injection pipe element, instead of a single slender pipe, there may be used a combination of two slender pipes each of which has at its distal end an outlet provided with a check valve. A a plurality of the slender pipe combinations are bound in such a manner that the outlets of the different slender pipe combinations are located at different positions in the axial direction. By using such slender pipe combinations, a fluid A and a fluid B may separately be delivered through the different slender pipes and, after injected from the outlets at distal ends of the slender pipes, joined together to thereby enable injection of ground improving materials which show a shrt geletion time upon being joined together. (In this case, the reservoir 2 includes a fluid A reservoir 2*a* and a fluid B reservoir 2*b*.) Further, the injection of the ground improving materials may be carried out subsequently to the filling with the sealing material 32.

In the apparatus in FIG. 12 constructed as described above, the ground improving material in the reservoir 2 is delivered through the ducts 9, 9 . . . 9, the set 33 of the unit pumps and the ducts 10, 10 . . . 10, and via flow rate and pressure sensors 27, 27 . . . 27, to the injection pipes 8, 8 . . . 8 and injected concurrently or selectively from the outlets 7-1, 7-2 . . . 7-i in desired amounts into the injection point 6 in the ground 1 to form bulb-shaped protrusions while breaking through mortar (sealing material) 32 for sealing at the predetermined depths.

FIGS. 13(*a*) and 13(*b*) are a system diagram of another embodiment of the apparatus according to the present invention and a diagrammatic view showing arrangement of injection pipes in injection points, respectively. FIG. 13(*a*) shows a multipoint grouting apparatus A which is substantially the same apparatus as in FIG. 1, except that injection pipes 8, 8 . . . 8 each of which is comprised substantially of a plurality of bound slender pipes as in the embodiment shown in FIG. 12 are implanted in injection points 6, 6, . . . 6 in the first injection block and the second injection block as shown in FIG. 13(*b*) to carry out injection into the plurality of the injection points concurrently or selectively. The slender pipes which constitute the injection pipes 8, 8 . . . 8 shown in FIG. 13(*a*) are represented as T11, T12 . . . T1i . . . T1n; T21, T22 . . . T2i . . . T2n; . . . ; Ti1, Ti2 . . . Tii . . . Tin; . . . ; and Tn1, Tn2 . . . Tni . . . Tnn. These slender pipes are implanted in ground 1 in such a manner that outlets at distal ends of T11, T21 . . . Ti1 . . . and Tn1 are located at the first stage, outlets at distal ends of T12, T22 . . . Ti2 . . . and Tn2 at the second stage, outlets at distal ends of T1i, T2i . . . Tii . . . and Tni at the i-th stage, and outlets at distal ends of T1n, T2n . . . Tin . . . and Tnn at the n-th stage, as shown in FIG. 13(*b*).

In the embodiment shown in FIGS. 13(*a*) and 13(*b*), data on flow rates and/or pressures of a ground improving material which are detected by flow rate and pressure sensors 27, 27 . . . 27 disposed in mid-courses of a plurality of ducts 10, 10 . . . 10 are transmitted to a centralized control means 26, and the data are recorded and shown on a display in the centralized control means 26 to thereby en masse monitor the states of the injection. The injection is controlled in this manner.

Since an alluvium is formed generally by deposition of alluvial materials in the horizontal direction, coefficient of water permeability in the horizontal direction is higher than that in the vertical direction. In most cases, with respect also to the ground in FIG. 13(*b*), the soil layer at the first stage has substantially the same coefficient of water permeability at positions in the vicinity of any of the outlets located therein and is composed substantially of, for example, medium sand. Likewise, the soil layer at the n-th stage also has substantially the same coefficient of water permeability in the vicinity of any of the outlets located therein and composed substantially of, for example, fine sand. Accordingly, in such cases, multipoint injection is carried out, for example, in such a manner that the injection is first conducted concurrently with respect to the n injection pipes of T11, . . . Tn1 at the first stage and then conducted sequentially from the second stage to the n-th stage. In the case of FIG. 13(*b*), after completion of the injection into the first injection block, injection is conducted with respect to the second injection block. The states of the injection concerning the n injection pipes at the i-th stage are en masse monitored by means of an injection monitor as shown in FIG. 11 and so controlled as to carry out optimum injection with respect to each of the injection pipes.

In the present invention, the unit pumps are driven by the respective independent driving means such as motors, and the rotational speed changing means such as inverters are controlled by the centralized control means, and thereby, the unit pumps which are appropriately arranged into one set are operated as a multiple injection means. Further, the multiple injection means is capable of flexibly controlling the injection with respect to each of the plurality of the injection pipes according to the states of injection of the injection pipes. In other words, the multiple injection means has not only a function of controlling the injection from the plurality of the injection pipes (n injection pipes) as a whole but also a function of optimally controlling the injection with respect to each of the injection pipes. In the apparatus according to the present invention, the delivery rate for the injection is, for example, 0–5 liter/min per unit pump and 0–5×n liter/min per multiple injection means as a set of the unit pumps, and when the number (n) of the unit pumps is 30, 0–5×30 liter/min, i.e., 0–150 liter/min per multiple injection means.

As described above, by the use of the multiple injection means having a plurality of independently driven unit pumps, the multipoint grouting method according to the present invention is capable of, with respect to ground having soil layers different in soil condition such as soil texture, concurrently or selectively applying optimum injection to each of the soil layers and capable of one-, two- or three-dimensionally injecting a ground improving material into ground.

Further, the multipoint grouting apparatus according to the present invention comprises a multiple injection means which includes a plurality of unit pumps, as described above. Accordingly, the multipoint grouting apparatus is capable of concurrently or selectively injecting a desired ground improving material at desired delivery rates in desired amounts, and thus capable of realizing a shortened execution period of injection, and with respect to ground having soil layers which are different in soil condition such as soil texture, capable of applying optimum injection to each of the soil layers Moreover, the present invention is capable of effecting permeation grouting into a very fine-grained soil layer at a low delivery rate, for example, a variable delivery rate of lower than 1 to several liter/min, particularly, 1 to 7 liter/min in terms of one unit pump without causing breakage of ground, thereby increasing reliability of permeation grouting into a very fine-grained soil layer. Further, when a multiple injection means including, for example, 50 unit pumps is used, rapid execution may be effected by the delivery rate of 50 to 350 liters per minute in terms of the multiple injection means to realize shortening of execution period.

Furthermore, in the case where the fluid A and the fluid B are joined together in the course of the injection, a desired gelation time is obtained with respect to injection form each of the outlets by adjusting delivery rates of the fluids A and B. Further, even if the fluids flow out of intended area, the injection may be suspended with respect only to the pertinent injection pipe but continued with respect to the plurality of the other injection pipes. In addition, if all the injection pipes are left inserted in ground, the secondary injection may be carried out through other selected outlets. This enables effecting permeation injection under low pressure into ground uniformly throughout the site by means of all the injection pipes, as designed.

What is claimed is:

1. A multipoint grouting method comprising:

inserting a plurality of injection pipes each having an outlet into a plurality of injection points in ground; and concurrently injecting a ground improving material, via the injection pipes, from the plurality of the outlets into the plurality of injection points;

wherein a multiple injection means is used which includes a plurality of unit pumps driven by driving means independently of each other and controlled by a centralized control means, each of the unit pumps is provided with a rotational speed changing means controlled by the centralized control means, and the plurality of the unit pumps are connected through ducts to the plurality of the injection pipes, whereby the ground improving material is injected by operations of the plurality of the unit pumps from the plurality of the outlets into the plurality of the injection points in the ground.

2. The multipoint grouting method according to claim 1, wherein the outlets of the plurality of the injection pipes are located at different injection points when viewed in plan.

3. The multipoint grouting method according to claim 1, wherein the outlets of the plurality of the injection pipes are located at different injection points in a depth direction.

4. The multipoint grouting method according to claim 1, wherein a flow rate and pressure sensor is provided in mid-course of each of the ducts in communication with the plurality of the injection pipes, and data signals on flow rates and/or pressures of the ground improving material which are detected by the sensors are transmitted to the centralized control means, and based on the data, the ground improving material is injected from the unit pumps through the outlets of the plurality of the injection pipes into the plurality of the injection points in the ground.

5. The multipoint grouting method according to claim 4, wherein each of the unit pumps is provided with a rotational speed changing means controlled by the centralized control means equipped with an injection monitor, and the rotational speed changing means are operated based on the signals on the data detected by the flow rate and pressure sensors to thereby deliver the ground improving material to each of the injection pipes while keeping the ground improving material flowing at a desired flow rate and/or under desired pressure.

6. The multipoint grouting method according to claim 4, wherein the information transmitted by the data signals on the flow rates and/or pressures of the ground improving material which are detected by the flow rate and pressure sensors is displayed on an injection monitor to thereby en masse monitor the states of injection, and based on the monitoring, the injection is carried out while maintaining the flow rate and/or the injection pressure in each of the injection pipes within a desired range, and based on information as to the data, the injection is completed, suspended, discontinued, continued or resumed.

7. A multipoint grouting apparatus comprising:

a reservoir for a ground improving material;

a multiple injection means including a plurality of unit pumps in one plant and connected to the reservoir;

a plurality of injection pipes inserted in a plurality of injection points in ground and connected to the respective unit pumps through ducts, said injection pipes each having an outlet, wherein each of said unit pumps is driven by an independent driving means and controlled by a centralized control means;

a plurality of rotational speed changing means which are provided for the independently driven respective unit pumps and which are controlled by the centralized control means; and a plurality of flow rate and pressure sensors provided in mid-courses of the respective ducts wherein said flow rate and pressure sensors transmit data signals on flow rates and/or pressures to the centralized control means, and the ground improving material in the reservoir is delivered under pressure to each of the injection pipes by the operation of each of the unit pumps at a desired injection rate, under desired injection pressure and/or in a desired amount of injection, wherein the ground improving material is injected concurrently from the plurality of the outlets into a plurality of injection points in the ground.

8. The multipoint grouting apparatus according to claim 7, wherein each of the unit pumps is a plunger pump, a diaphragm pump, a squeeze pump or a snake pump.

9. The multipoint grouting apparatus according to claim 7, wherein the multiple injection means includes 5 or more unit pumps arranged one-dimensionally, two-dimensionally or three-dimensionally.

10. The multipoint grouting apparatus according to claim 9, wherein the plurality of the unit pumps are arranged in such a manner that the unit pumps are supported by a support or compactly stacked to prevent vibrations, deformation or distortion attributable to the operations of the plurality of the driving means.

11. The multipoint grouting apparatus according to claim 7, wherein the ground improving material is injected from the plurality of the independently driven unit pumps through the plurality of the injection pipes into the plurality of the injection points in the ground while transmitting the data signals on flow rates and/or pressures of the ground improving material which are detected by the flow rate and pressure sensors to the centralized control means to en masse monitor the states of injection by means of an injection monitor of the centralized control means.

12. The multipoint grouting apparatus according to claim 7, wherein the rotational speed changing means are controlled based on the data signals on flow rates and/or pressures of the ground improving material which are transmitted to the centralized control means to thereby deliver the ground improving material to the injection pipes at desired flow rates and/or under desired pressures.

13. The multipoint grouting apparatus according to claim 7, wherein the data signals on the flow rates and/or pressures of the ground improving material which are detected by the flow rate and pressure sensors are transmitted to the centralized control means, and the data are displayed on an injection monitor of the centralized control means to thereby en masse monitor the states of injection, and based on the monitoring, the injection is carried out while maintaining the flow rate and/or the injection pressure in each of the injection pipes within a desired range, and based on the information as to the data, the injection is completed, suspended, discontinued, continued or resumed.

* * * * *